US010590949B2

(12) United States Patent
Gebert et al.

(10) Patent No.: US 10,590,949 B2
(45) Date of Patent: Mar. 17, 2020

(54) VENTILATOR WHEEL AND VENTILATOR

(71) Applicant: ebm-papst Mulfingen GmbH & Co. KG, Mulfingen (DE)

(72) Inventors: Daniel Gebert, Oehringen (DE); Jens Mueller, Kuenzelsau (DE); Alexander Konzal, Igersheim (DE); Michael Strehle, Ingelfingen (DE)

(73) Assignee: ebm-papst Mulfingen GmbH & Co. KG, Mulfingen (DE)

( * ) Notice: Subject to any disclaimer, the term of this patent is extended or adjusted under 35 U.S.C. 154(b) by 99 days.

(21) Appl. No.: 15/549,410

(22) PCT Filed: Dec. 30, 2015

(86) PCT No.: PCT/EP2015/081392

§ 371 (c)(1),
(2) Date: Aug. 8, 2017

(87) PCT Pub. No.: WO2016/128099

PCT Pub. Date: Aug. 18, 2016

(65) Prior Publication Data

US 2018/0030994 A1 Feb. 1, 2018

(30) Foreign Application Priority Data

Feb. 11, 2015 (DE) ..... 10 2015 101 938

(51) Int. Cl.
*F04D 29/30* (2006.01)
*F04D 17/16* (2006.01)
(Continued)

(52) U.S. Cl.
CPC ..... *F04D 29/30* (2013.01); *F04D 17/16* (2013.01); *F04D 29/281* (2013.01);
(Continued)

(58) Field of Classification Search
CPC ..... F04D 29/30; F04D 17/16; F04D 29/281; F04D 29/441; F04D 25/08; F05D 2250/14
(Continued)

(56) References Cited

U.S. PATENT DOCUMENTS 5,336,050 A * 8/1994 Guida ..... F04D 29/282 29/889.21
6,019,808 A * 2/2000 Ishikawa ..... B01D 46/10 55/320
(Continued)

FOREIGN PATENT DOCUMENTS

DE 20018770 U1 5/2001
DE 102010009566 A1 9/2011
(Continued)

OTHER PUBLICATIONS

International Search Report (in German with English Translation) for PCT/EP2015/081392, dated Apr. 20, 2016; ISA/EP.

*Primary Examiner* — John M Zaleskas
*Assistant Examiner* — Susan E Scharpf
(74) *Attorney, Agent, or Firm* — Harness, Dickey & Pierce, P.L.C.

(57) ABSTRACT

The invention relates to a ventilator wheel which is produced in the form of a radial or a diagonal ventilator wheel, and comprises a bottom disc and a plurality of ventilator blades arranged, on said bottom disc, so as to be distributed about an axial rotational axis, said bottom disc comprising a circumferential radial outer edge section that, when viewed in cross-section, extends in a curved shape in at least some sections and thus forms an elliptical transition of said bottom disc from a radial extension into an axial extension.

14 Claims, 2 Drawing Sheets

Figure 1:
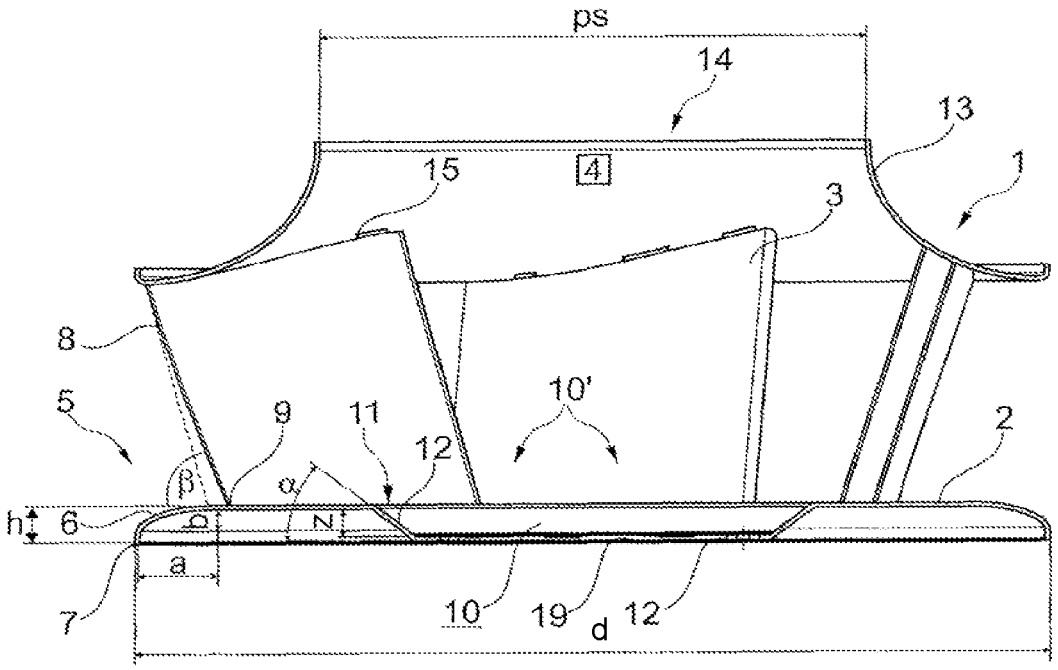

(51) Int. Cl.
*F04D 29/28* (2006.01)
*F04D 29/44* (2006.01)
*F04D 25/08* (2006.01)

(52) U.S. Cl.
CPC ..... *F04D 29/288* (2013.01); *F04D 29/441* (2013.01); *F04D 25/08* (2013.01); *F05D 2250/14* (2013.01)

(58) Field of Classification Search
USPC ..... 416/179
See application file for complete search history.

(56) References Cited

U.S. PATENT DOCUMENTS 6,039,111 A * 3/2000 Kawaguchi ..... F28D 15/0266 165/104.14
6,146,094 A * 11/2000 Obana ..... F04D 29/023 415/200
6,558,120 B2 * 5/2003 Kim ..... F04D 25/12 416/186 R
6,604,906 B2 * 8/2003 Ozeki ..... F04D 25/082 415/204
6,848,887 B2 * 2/2005 Kim ..... F04D 29/023 249/59
7,614,250 B2 * 11/2009 Sanagi ..... F04D 25/082 416/181
8,006,512 B2 * 8/2011 Sanagi ..... F24F 1/0011 62/426
8,225,623 B2 * 7/2012 Ikeda ..... F04D 29/281 62/419
8,784,060 B2 * 7/2014 Iwata ..... F04D 29/282 416/185
2004/0244403 A1 * 12/2004 Kim ..... F04D 17/165 62/419
2010/0202886 A1 * 8/2010 Iwata ..... F04D 29/30 416/182
2012/0063899 A1 * 3/2012 Ikeda ..... F04D 25/088 416/146 R

FOREIGN PATENT DOCUMENTS

EP 2829732 A1 * 1/2015 ..... F04D 29/023
EP 2829732 A1 1/2015
GB 18349 A 6/1911
JP 2002-168507 * 11/2000 ..... F24F 7/04
JP 2007002708 A * 1/2007 ..... F04D 29/30
JP 2011163690 A 8/2011

* cited by examiner

VENTILATOR WHEEL AND VENTILATOR

CROSS REFERENCE TO RELATED APPLICATIONS

This application is a U.S. National Phase Application under 35 U.S.C. 371 of International Application No. PCT/EP2015/081392 filed on Dec. 30, 2015 and published in German as WO 2016/128099 A1 on Aug. 18, 2016. This application claims priority to German Application No. 10 2015 101 938.8 filed on Feb. 11, 2015. The entire disclosures of all of the above applications are incorporated herein by reference.

The invention concerns a ventilator wheel designed as a radial ventilator wheel or diagonal ventilator wheel as well as a ventilator in which a corresponding ventilator wheel is installed.

Such radial ventilator wheels are known from the prior art, such as DE 10 2010 009 566 A1 and DE 20 018 770 U1.

Such radial ventilator wheels are used preferably in volume flow conducting elements (such as air handling units) in the field of ventilation and air conditioning. Per standards, the characteristics of the radial ventilator wheels are measured in room test stands where the delivered air can flow unhindered and radially to the outside. In such an installed situation, the air flow then lies against the room wall running in a prolongation of the radial direction of the ventilator wheel.

In the practical application, however, usually a different outflow situation occurs, in which the flow is diverted from the radial to the axial direction and then lies against the axially parallel and not the radial housing wall of the volume flow conducting element. Typically, this flow situation has an adverse effect on the efficiency of the ventilator wheel.

Therefore, the problem which the invention proposes to solve is to provide a ventilator wheel as well as a ventilator having an improved efficiency in the realistic installation situation.

According to the invention, a ventilator wheel is provided which is designed as a radial ventilator wheel or diagonal ventilator wheel and comprises a bottom disk, on which a plurality of ventilator blades is arranged and distributed about an axial axis of rotation, whose axial height dimension runs between the intake side and the bottom disk. The bottom disk has a circumferential radial outer rim section which runs at least for a portion as a curved shape, looking in the cross section, and thereby forms a circumferential elliptical transition of the bottom disk from a radial extension to an axial extension. The axial extension runs parallel to the axis of rotation of the ventilator wheel on a side of the bottom disk which is opposite the ventilator blades.

The elliptical curved shape of the radial outer rim section brings about a reduction or even an elimination of the losses caused by the installation in a volume flow conducting element. The efficiency is improved by at least 0.1 as compared to the radial ventilator wheels known in the prior art. This has been confirmed in several measurements, as described more fully below.

The elliptical transition (in cross section) of the circumferential radial outer rim section is dictated by a longer and a shorter half-axis length. In a variant embodiment of the invention which is advantageous in regard to the efficiency and the reduced losses, it is provided that the half-axis length ratio a/b lies in a range of 1 to 10, preferably 2 to 5, where "a" corresponds to a half-axis length in the radial direction and "b" to a half-axis length in the axial direction of the ventilator wheel.

The ventilator blades arranged or formed on the bottom disk each have a radial outer edge, each forming a transition point on a side with the bottom disk. An imaginary ring joining the transition points in the circumferential direction forms a boundary line to which the elliptical transition of the bottom disk is adjacent immediately or with a spacing in the radial direction, i.e., the bottom disk extends in the radial direction beyond the ventilator blades and thereby forms the elliptical transition. Thus, the flow can move along the bottom disk without influence from the ventilator blades and then be guided in the outer radial region of the elliptical transition in regard to the further direction of flow.

In addition to the elliptical transition, the bottom disk in one sample embodiment is formed with an axial prolongation, which extends in the axial direction adjoining the elliptical transition as a single piece and provides a further guiding for the air flow.

In a further variant embodiment of the invention, it is provided that the bottom disk has an axially encircling step in the center region extending outside the axis of rotation. This step is formed as a kind of beveled edge of the bottom disk and transposes the parts of the bottom disk lying in the center region onto a parallel axial plane. The step or bevel increases the stiffness of the bottom disk and thus that of the ventilator wheel. In combination with the elliptical transition, the effect is further intensified. Moreover, the step or bevel pointing away from the ventilator blades in an axial direction additionally means that the rotor of an electric motor which is secured in the center region of the bottom disk does not protrude as much in the direction of the ventilator blades. In a further embodiment of the invention, a hub is formed on the bottom disk for this, adjoining the step in the direction of the axis of rotation at the center.

In one advantageous variant embodiment, the axial step or bevel of the bottom disk is substantially Z-shaped, looking in the cross section, with a web extending partly in the radial and axial direction, i.e., running at a slant to the axis of rotation. The slanting web of the bottom disk, joining the straight top and bottom legs of the Z, runs preferably at an angle $\alpha$ of 20 to 60 degrees with respect to the radial direction of the ventilator wheel.

The step or bevel in one favorable variant embodiment has an axial height Z corresponding to ±20% of the half-axis length b of the elliptical transition in the axial direction. In this way, the elliptical transition works together especially effectively with the step to promote the stiffness of the bottom disk and the ventilator wheel.

Moreover, in one embodiment of the invention it is provided that the ventilator wheel has a cover disk opposite the bottom disk and covering at least partly the ventilator blades on the intake side, forming an inlet opening about the axis of rotation at the center. The ventilator blades are not completely covered by the cover disk along their top edges pointing toward the intake side, but instead in one sample embodiment they each have a marginal segment pointing toward the intake side, running separately from the cover disk, in order to improve the guided flow.

The cover disk and the bottom disk have substantially the same outer diameter. As one possible variant of the invention, it is provided that an imaginary envelope curve around the ventilator blades in the circumferential direction runs at an oblique angle ($\beta$) of 60 to 80 with respect to a radial extension of the bottom disk, i.e., in a lateral section the ventilator blades run at a slant to an axial plane of the ventilator wheel and pointing in the direction of the axis of rotation of the bottom disk.

Furthermore, a size ratio of the bottom disk has proven to be effective wherein the ratio d/h, i.e., the outer diameter d of the bottom disk and its total axial height h, lies in a range of 20 to 25. Moreover, in one favorable embodiment the ratio d/a of the outer diameter d of the bottom disk to the half-axis length a of the elliptical transition is in a range of 10 to 15, preferably 11 to 12, and the ratio d/b of the outer diameter d of the bottom disk to the half-axis length b of the elliptical transition lies in a range of 28 to 38, preferably 30 to 34. The inlet opening determined by the cover disk in one advantageous embodiment has a diameter sd, having in relation to the half-axis length b of the elliptical transition a value sd/b in a range of 15 to 25, especially 18 to 21, and in relation to the half-axis length a of the elliptical transition a value sd/a in a range of 5 to 8, especially 6 to 7.

The invention moreover involves a ventilator with an above-described ventilator wheel, which is arranged in a volume flow conducting component with a preferably square flow cross section with an edge length G. In order to achieve an especially advantageous flow situation with a flow diverted by the ventilator wheel from the radial to the axial direction, the ratio of the edge length G to the outer diameter D of the ventilator wheel is in a range of 1.1 to 3.0, preferably 1.5 to 2.5.

All disclosed features of the ventilator wheel can be combined at will, insofar as this is technically possible.

Figure 2:
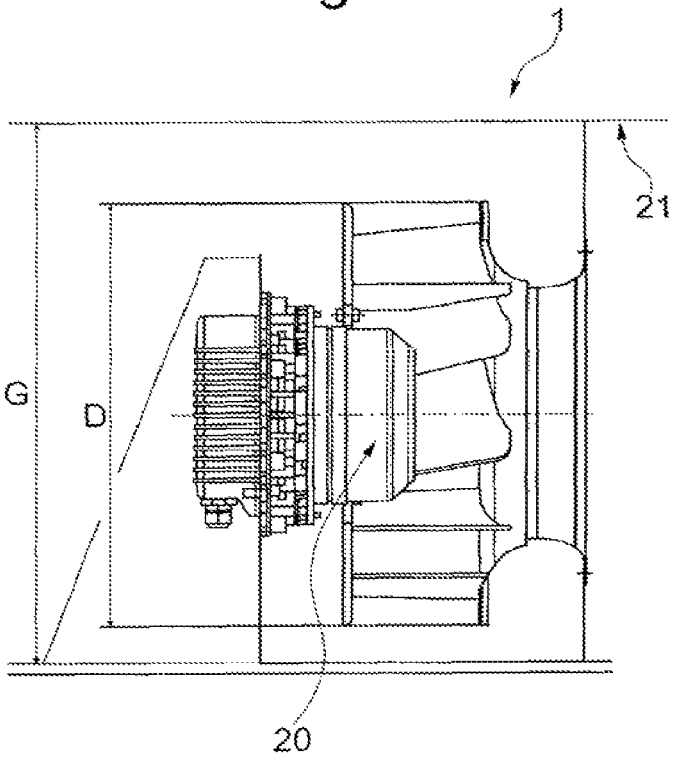
Figure 3:
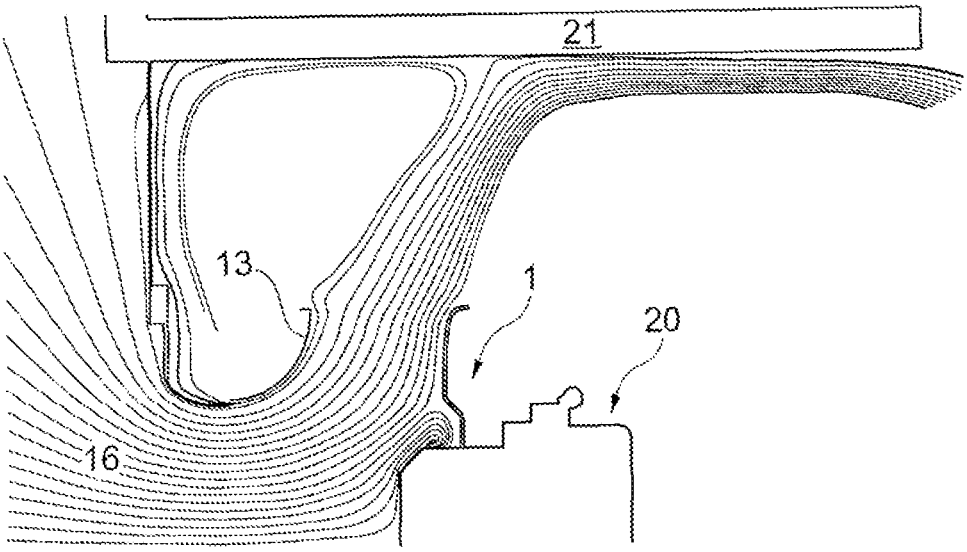
Figure 4:
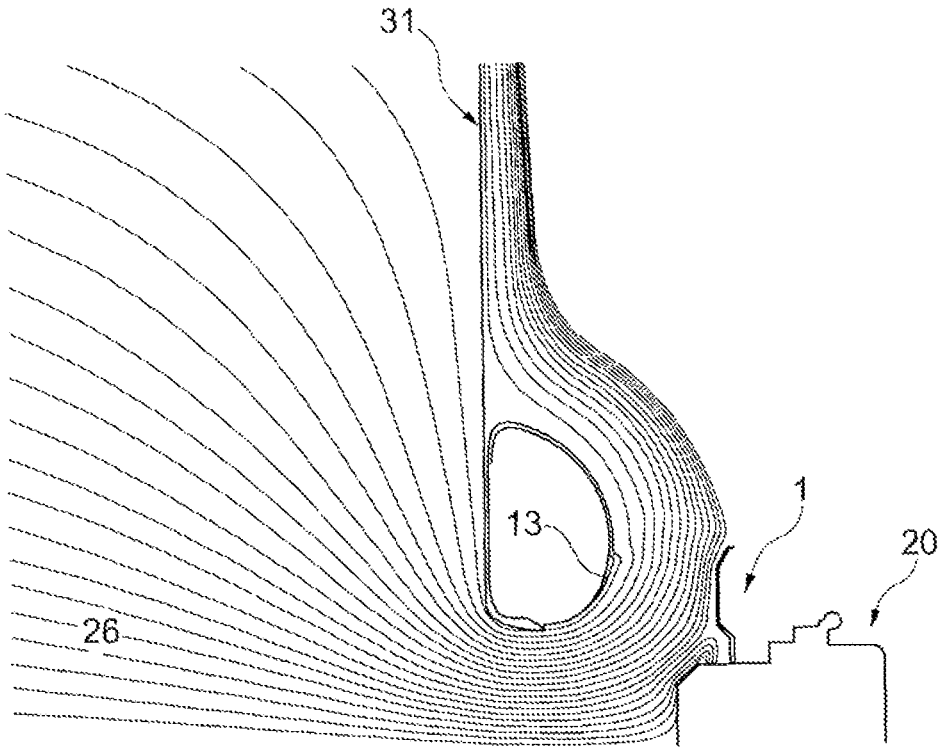

Other advantageous modifications of the invention are characterized in the subclaims or shall be presented more closely below together with the description of the preferred embodiment of the invention with the aid of the figures. There are shown:

FIG. 1, a lateral sectional view of a ventilator wheel;

FIG. 2, a schematic representation of a ventilator in a volume flow conducting element;

FIG. 3, a representation of the flow in a volume flow conducting element;

FIG. 4, a representation of the flow in a room test stand.

FIG. 1 shows a lateral sectional view of a radial ventilator wheel 1 with a bottom disk 2 and a cover disk 13 provided on the intake side 4 and forming an air inlet opening 14, between which there are provided a plurality of ventilator blades 3 arranged distributed about the axial axis of rotation. The ventilator blades 3 extend on the bottom disk 2 from a center region 10' radially and in part diagonally outward and form a radial air outlet region at their outer radial edge 8. The ventilator blades 3 are each curved in shape, so that they run in an arc in a top view and have an upper marginal segment 15 free of the cover disk 13 in a region toward the axial center. The radial outer edges 8 of the ventilator blades 3 end on the bottom disk 2 each time at a transition point 9. The axially slanting extension of the outer edges 8 of the ventilator blades 3 from the bottom disk 2 to the cover disk 13 occurs in the embodiment depicted with an angle β of around 70 degrees, while the ventilator blades 3 form with the cover disk 13 a substantially flush radially outer edge closure. If the transition points 9 are joined into a ring, an imaginary boundary line is formed, to which the elliptical transition 6 of the bottom disk 2 is immediately adjacent in the radial direction or, as in the depicted embodiment, with a slight spacing. The starting point of the elliptical transition 6 in the radial direction is defined as the beginning of the curvature of the bottom disk 2 in the axial direction.

The bottom disk 2 has a circumferential radial outer margin section 5, which in the lateral cross section shown runs in an arc and forms the elliptical transition 6 of the bottom disk 2 from its radial extension outwardly to an axial extension on a side opposite the ventilator blades 3. The elliptical transition 6 is determined by the half-axis lengths a and b, whose ratio a/b in the embodiment shown has a value of around 3.0. Once the extension of the bottom disk 2 is parallel to the axis of rotation, the elliptical transition 6 is considered to be completed. Thereafter, the axial prolongation 7 is formed as a single piece in the axial direction.

Around the axis of rotation of the bottom disk 2 there is provided a central opening 19 at a center 10 about the axis of rotation, on whose radially outer rim is formed the hub 12. In a central region 10' extending about its center 10 the bottom disk 2 has an axial, substantially Z-shaped step 11, while the slanting web 12 of the Z extending partly in the radial and partly in the axial direction runs at an angle α of around 40 degrees with respect to the radial direction of the ventilator wheel 1, i.e., in a plane parallel to the bottom disk 2. The step 11 in the embodiment shown has an axial height Z which is around 15% larger than the half-axis length b of the elliptical transition 6 in the axial direction. The ratio d/h between the outer diameter d of the bottom disk 2 and its total axial height h is set at a value of around 23 in the embodiment shown.

FIG. 2 shows a schematic representation of a ventilator 20 with the ventilator wheel 1 in a state installed centrally to the axis of a volume flow conducting element 21. The volume flow conducting element 21 in the embodiment shown has a square cross section with an edge length G, which is larger by a factor of 1.3 than the outer diameter D of the ventilator wheel 1.

The layout represented in FIG. 2 corresponds to a realistic installation situation of the ventilator 20 as well as the ventilator wheel 1. This generates a flow 16 with a variation as shown in FIG. 3. After being taken in through the intake opening 14, the air is at first blown out radially from the ventilator wheel 1. After this, the major portion of the flow 16 lies against the inner wall of the volume flow conducting element 21 in the axial direction and has undergone a directional change from radial to axial. The flow 26 achieved in the room test stand lies against a wall 31 continuing in the radial direction of the ventilator wheel 1, as shown for example in FIG. 4. There is no deflection of the flow here.

The invention is not limited in its embodiment to the preferred sample embodiments indicated above. Instead, a number of variants are conceivable, making use of the presented solution even with fundamentally different embodiments. For example, the axial prolongation 7 may also be slanting or curved in configuration. Furthermore, a change can be provided in the material thickness of the bottom disk, for example, with a tapering in the direction of the axial prolongation.

What is claimed is:

1. A ventilator wheel comprising: a bottom disk and a plurality of ventilator blades arranged and distributed about an axial axis of rotation on the bottom disk, whose axial height dimension runs between an intake side and the bottom disk, wherein the bottom disk has a body with a flat section and a circumferential radial outer rim section which runs at least for a portion as a curved shape, looking in the cross section, and thereby forms an elliptical transition of the bottom disk from a radial extension to an axial extension, the bottom disk includes a hub spaced from the flat section, the hub projects away from the intake side and away from the ventilation blades in the direction from the intake side to the bottom disk, the hub includes an axial step connecting the hub with the body, the axial step is in the center region lying outside the axis of rotation, the axial step is Z-shaped, in cross section, with a web extending partly in the radial and axial direction, the web runs at an angle of 20 to 60 degrees with respect to the radial direction of the ventilator wheel, the hub in alignment with the axial extension of the curved shape outer rim section, the ventilator blades having a radial outer edge, each forming a transition point on a side with the bottom disk, and an imaginary ring joining the transition points in the circumferential direction forms a boundary line for the flat section, to which the elliptical transition of the bottom disk is adjacent immediately or with a spacing in the radial direction.

2. The ventilator wheel according to claim 1, wherein the elliptical transition in the circumferential radial outer rim section of the bottom disk has a half-axis length ratio (a)/(b) in a range of 1 to 10, where (a) corresponds to a half-axis length in the radial direction and (b) to a half-axis length in the axial direction of the ventilator wheel.

3. The ventilator wheel according to claim 1, wherein an axial prolongation is formed in the axial direction on the elliptical transition as a single piece.

4. The ventilator wheel according to claim 1, wherein a hub is formed on the bottom disk, adjoining the step in the radial direction.

5. The ventilator wheel according to claim 1, wherein the step has an axial height corresponding to ±20% of the half-axis length (b) of the elliptical transition in the axial direction.

6. The ventilator wheel according to claim 1, further comprising a cover disk, opposite the bottom disk, covering at least partly the ventilator blades on the intake side, and forming an inlet opening extending about the axis of rotation.

7. The ventilator wheel according to claim 6, wherein the ventilator blades each have a marginal segment pointing toward the intake side, extending separately from the cover disk.

8. The ventilator wheel according to claim 1, wherein an imaginary envelope curve runs around the ventilator blades in the circumferential direction at an oblique angle of 60 to 80 degrees with respect to a radial extension of the bottom disk.

9. The ventilator wheel according to claim 1, wherein a ratio (d)/(h) of an the outer diameter (d) of the bottom disk to a total axial height (h) of the bottom disk lies in a range of 20 to 25.

10. The ventilator wheel according to claim 1, wherein a ratio (d)/(a) of the outer diameter (d) of the bottom disk to the half-axis length (a) of the elliptical transition is in a range of 10 to 15.

11. The ventilator wheel according to claim 1, wherein the ventilator is arranged in a volume flow conducting component with a square flow cross section with an edge length, and a ratio of the edge length to an outer diameter of the ventilator wheel is in a range of 1.1 to 3.0.

12. The ventilator wheel according to claim 2, wherein the range is 2 to 5.

13. The ventilator wheel according to claim 10, wherein the range is 11 to 12.

14. The ventilator wheel according to claim 11, wherein the range is 1.5 to 2.5.

* * * * *